US005496193A

United States Patent [19]

Kameyama

[11] Patent Number: 5,496,193

[45] Date of Patent: Mar. 5, 1996

[54] OIL INTERRUPTING CONNECTOR

[75] Inventor: Isao Kameyama, Shizuoka, Japan

[73] Assignee: Yazaki Corporation, Tokyo, Japan

[21] Appl. No.: 324,986

[22] Filed: Oct. 18, 1994

[30] Foreign Application Priority Data

Oct. 18, 1993 [JP] Japan ..... 5-282137

[51] Int. Cl.[6] ..... H01R 4/70

[52] U.S. Cl. ..... 439/589

[58] Field of Search ..... 439/271, 274, 439/275, 587, 589, 750, 879

[56] References Cited

U.S. PATENT DOCUMENTS 4,576,428 3/1986 DeLuca et al. ..... 439/271
4,921,437 5/1990 Cooper et al. ..... 439/587

FOREIGN PATENT DOCUMENTS 2278673 11/1990 Japan .

*Primary Examiner*—Gary F. Paumen
*Attorney, Agent, or Firm*—Sughrue, Mion, Zinn, Macpeak & Seas

[57] ABSTRACT

An oil retaining plug is held on a terminal. An outer periphery of this plug is held in intimate contact with an inner periphery of a terminal receiving chamber, and this plug surrounds a portion of the terminal in intimate contact therewith, thereby form a seal between the inner periphery of the terminal receiving chamber and the terminal. A lip for intimate contact with the inner periphery of the terminal receiving chamber may be formed on the outer periphery of the oil retaining plug. Preferably, the oil retaining plug has a slit which fits on a portion of the terminal to surround this portion in intimate contact therewith.

4 Claims, 3 Drawing Sheets

OIL INTERRUPTING CONNECTOR

BACKGROUND OF THE INVENTION

1. Field of Invention

This invention relates to a connector for electrically connecting an electric component within a transmission to the exterior, and more particularly to a connector of the type which interrupts oil against intrusion into a connector fitting portion through a wire connected to the electric component.

2. Related Art

For electrically connecting an electric component within a transmission to the exterior, it is necessary to provide a construction by which oil within the transmission is prevented from intruding into a connector mounted on a transmission casing. One example of a connector of this type in which a filler is poured into a connector housing to interrupt oil is disclosed in Japanese Patent Unexamined Publication No. 2-278673, and its general construction will now be described with reference to FIG. 5.

A connector housing 3 closely fits in and extend through an opening in a transmission casing 1, and that portion of the housing 3 disposed outside the transmission casing 1 serves as a fitting portion. Terminal receiving chambers 5 are formed in that portion of the housing 3 disposed inside the transmission casing, and terminal 7 are received respectively in the terminal receiving chambers 5, the terminals 7 extending into the fitting portion. A wire 9 is connected at one end to each terminal 7 by compressive clamping, and extends from the rear side of the terminal receiving chamber 5 into oil 11. Another connector 13 is connected to the other end of the wire 9 disposed in the oil 11, and the connector 13 is connected to an electric component (not shown) in the oil 11.

A filler 15, such as silicone, is filled in each terminal receiving chamber 5 of the housing 3, and the filler 15 seals the terminal receiving chamber 5.

In the conventional connector of this construction, when the oil 11 intrudes into a gap between a conductor 17 and a covering 19 of the connector 13 provided in the oil 11, the oil moves toward the housing 3 along the conductor 17 because of a capillary phenomenon. However, since the gap between the conductor 17 and the covering 19 in the housing 3 is sealed by the filler 15, the passage of flow of the oil 11 is interrupted, thereby preventing the oil 11 from intruding into the fitting portion of the connector.

As described above, in the conventional connector, the filler 15 is filled in the terminal receiving chamber 5 in order to satisfactorily prevent the oil from intruding into the fitting side, thereby preventing a short-circuit accident due to leakage of the oil 11.

However, for pouring silicone into each terminal receiving chamber 5 so as to prevent an oil leakage, much time is required because care must be exerted not to invite incomplete pouring. It also takes much time for the poured silicone to be cured by heating. Thus, this has been found quite poor in operation efficiency.

Another drawback is that since silicone of a relative high specific gravity is filled in an amount corresponding to the volume of the terminal receiving chambers, the overall weight of the connector is increased.

A further problem is that since silicone to be filled is costly, the manufacturing cost is increased.

SUMMARY OF THE INVENTION

The prevent invention has been made in view of the above problems, and an object of the invention is to provide an oil interrupting connector in which an oil interrupting structure can be realized easily, and this structure can be more lightweight than the conventional filling structure, and besides expensive materials are not needed in a large amount, thereby enhancing an operation efficiency and also reducing the weight and the manufacturing cost.

The above object has been achieved by an oil interrupting connector of the present invention wherein a connector housing extends through a transmission casing in intimate contact therewith in such a manner that that portion of the housing disposed outside the transmission casing serves as a fitting portion; a terminal is received in a terminal receiving chamber provided in an inner portion of the connector housing; and one end of a wire is connected to the terminal whereas the other end of the wire is disposed in oil, wherein an oil retaining plug is held on the terminal, an outer periphery of the plug being in intimate contact with an inner periphery of the terminal receiving chamber, and the plug surrounding a flat plate portion of the terminal, disposed between a conductor clamping portion and a positioning stabilizer, in intimate contact therewith, so that the plug forms a seal between the inner periphery of the terminal receiving chamber and the terminal.

In the oil interrupting connector, an annular lip may be formed on the outer periphery of said oil retaining plug, the annular lip being held in intimate contact with the inner periphery of the terminal receiving chamber.

In the oil interrupting connector, a slit may be formed in the oil retaining plug, said slit being fitted on the flat plate to surround the flat plate portion in intimate contact therewith.

When the oil, moved toward the connector housing along a conductor because of a capillary phenomenon, flows into the terminal receiving chamber in the housing, the oil is interrupted by the oil retaining plug since the oil retaining plug forms a seal between the terminal and the terminal receiving chamber. Therefore, the oil will not intrude into the fitting side of the terminal.

In the oil interrupting connector in which the lip is formed on the outer periphery of the oil retaining plug, a line-contact seal is positively formed between the inner periphery of the terminal receiving chamber and the outer periphery of the oil retaining plug, thereby enhancing the oil interrupting ability.

Furthermore, in the oil interrupting connector in which a slit holding a portion of the terminal is formed in the oil retaining plug, the oil retaining plug for interrupting the oil can be easily held on the terminal.

DETAILED DESCRIPTION OF THE PREFERRED EMBODIMENTS

A preferred embodiment of an oil interrupting connector of the present invention will now be described in detail with reference to the drawings.

Figure 1:
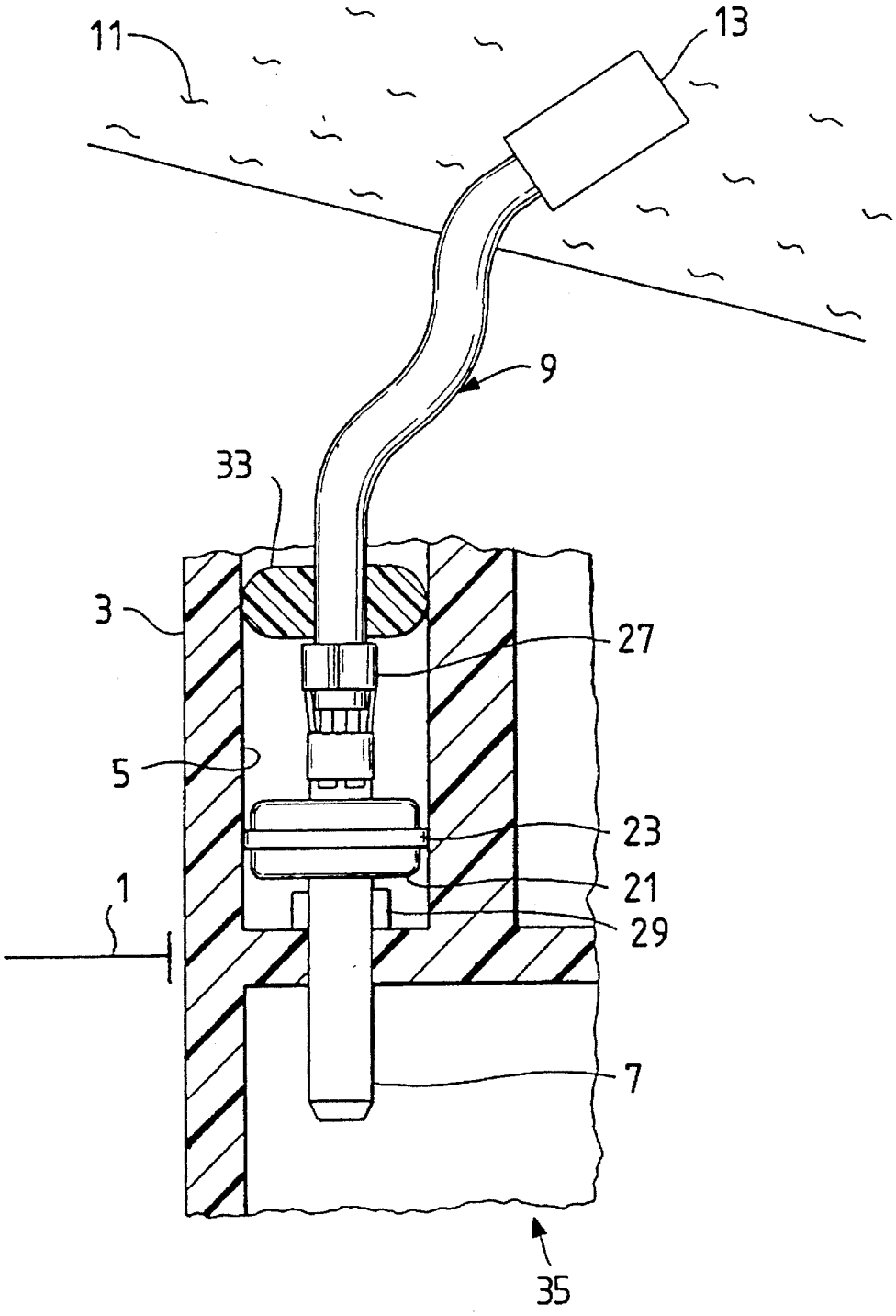
FIG. 1 is a cross-sectional view of an important portion of an oil interrupting connector of the present invention.
Figure 2:
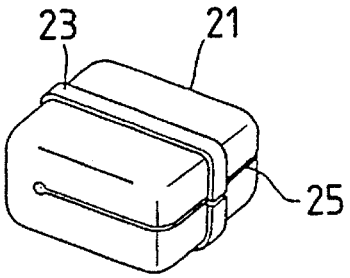
FIG. 2 is a perspective view of an oil retaining plug used in the oil interrupting connector of FIG. 1.
Figure 3:
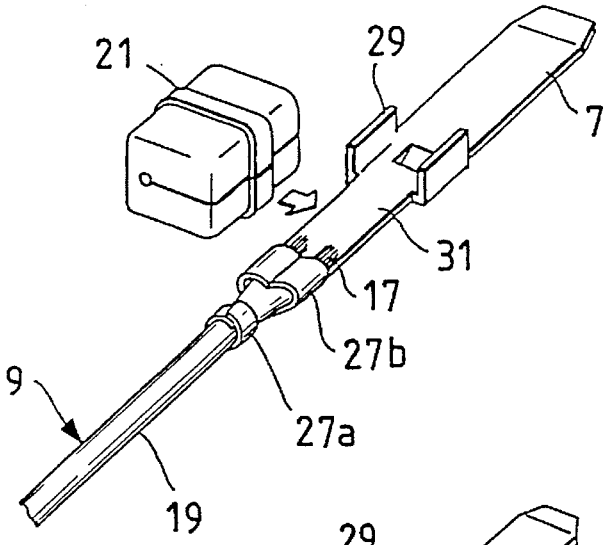
FIG. 3 is a perspective view of a terminal before attaching the oil retaining plug of the oil interrupting connector of FIG. 1.
Figure 4A:
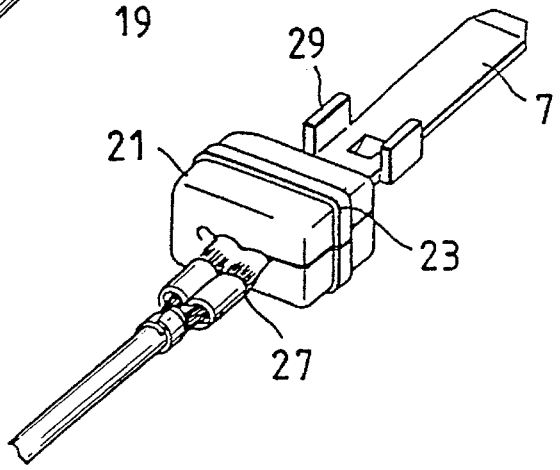
FIGS. 4 (*a*) and (*b*) are a perspective view and a cross sectional view of the terminal after the oil retaining plug of the oil interrupting connector of FIG. 1 is attached, respectively.
Figure 4B:
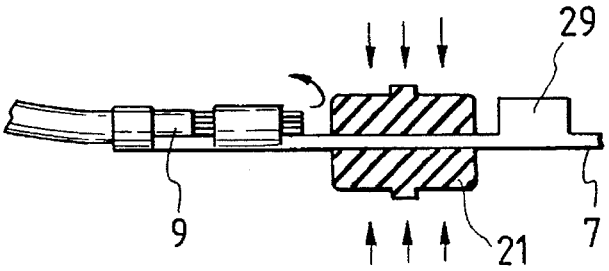
Figure 5:
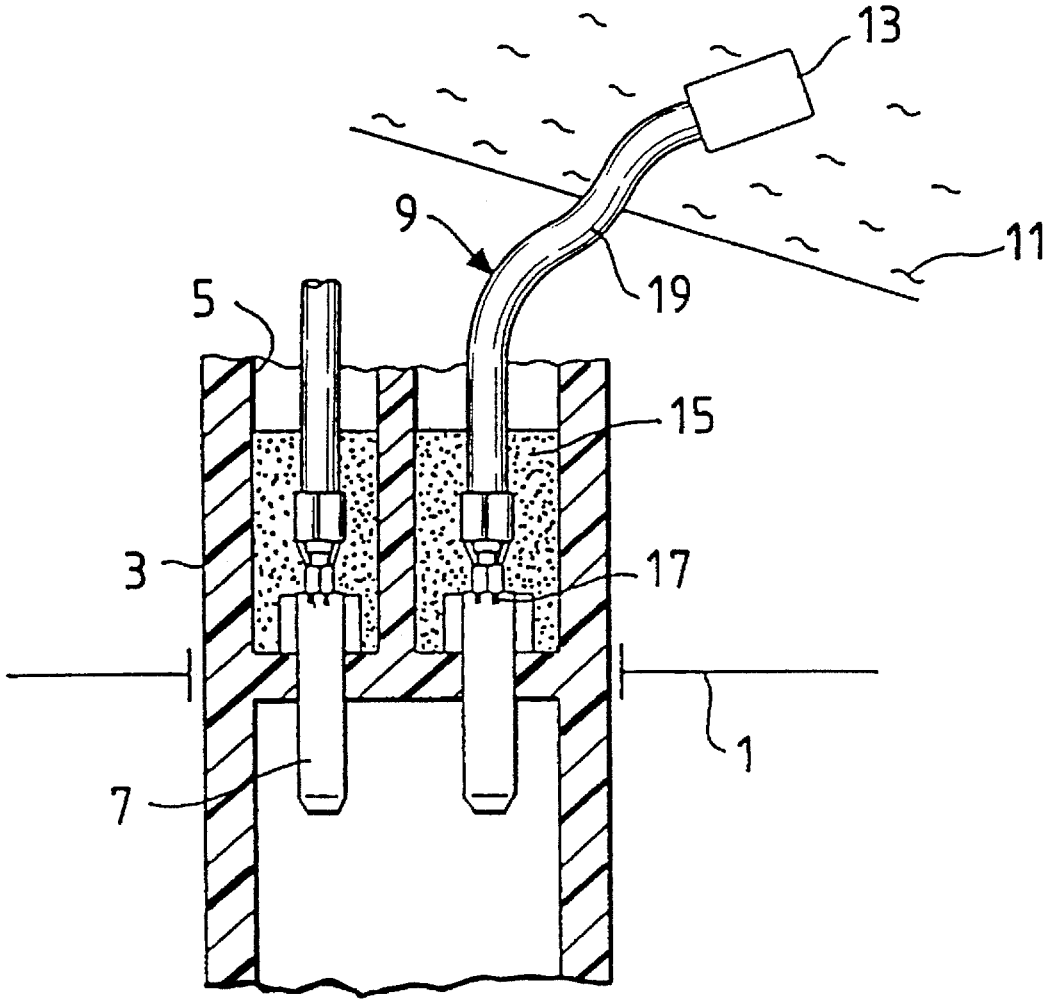
FIG. 5 PRIOR ART
FIG. 5 is a cross-sectional view of a conventional connector.

FIG. 1 is a cross-sectional view of an important portion of an oil interrupting connector of the present invention, FIG. 2 is a perspective view of an oil retaining plug, FIG. 3 is a perspective view of a terminal before attaching the oil retaining plug, and FIG. 4 is a perspective view of the terminal after the oil retaining plug is attached. Those parts identical to those of FIG. 5 are designated by the same reference numerals, and explanation thereof will be omitted to avoid repetition.

An elastomeric oil retaining plug 21 of a rectangular parallelepipedic configuration, which is made, for example, of rubber, is inserted in a terminal receiving chamber 5 of a housing 3, and has an outer shape conforming to an inner shape of the terminal receiving chamber 5. As shown in FIG. 2, an annular lip 23 is formed in a bulged manner on the outer periphery of the oil retaining plug 21, and this lip 23 is held in intimate contact with the inner periphery of the terminal receiving chamber 5. Namely, a seal is formed between the oil retaining plug 21 and the terminal receiving chamber 5 by the lip 23. A slit 25 is formed in the oil retaining plug 21, and extends across part of the lip 23, and the slit 25 generally divides the oil retaining plug 21 into two halves. Therefore, the oil retaining plug 21 can be opened at the slit about that portion thereof (that is, connecting portion) where the slit 25 is not provided.

The oil retaining plug 21 need only to have such a size that this plug can be held in intimate contact with the inner periphery of the terminal receiving chamber 5 at a portion of this chamber. Therefore, the oil retaining plug 21 can be smaller in volume than the filler filled in the terminal receiving chamber 5 of the conventional construction. Therefore, the weight of this structure is far smaller than that of the conventional filling structure. Moreover, a mass production can be made possible by integral molding, and the manufacturing cost is reduced.

As shown in FIG. 3, a terminal 7 to be received in the terminal receiving chamber 5 has at its rear portion a covering clamping portion 27*a* and a conductor clamping portion 27*b*. The conductor clamping portion 27*b* compressively holds a conductor 17 of that portion of a wire 9 from which a covering 19 is removed. Stabilizers 29 serving as a stopper are formed at a front end portion of the terminal 7. When the terminal 7 is inserted into the terminal receiving chamber 5, the stabilizers 29 abut against a front wall of the terminal receiving chamber to fix the terminal 7 in position.

The terminal 7 has a flat plate portion 31 lying between the stabilizers 29 and the conductor clamping portion 27*b*. The oil retaining plug 21 is attached to the terminal by fitting the slit 25 on the flat plate portion 31. The oil retaining plug 21, when opened, produce a resilient holding force acting in a direction to hold the flat plate portion 31, and the oil retaining plug 21 is held on the flat plate portion 31 by this holding force. In this condition, a portion of the terminal 7 is surrounded by the oil retaining plug 21 in intimate contact therewith.

The terminal 7, having the oil retaining plug 21 attached thereto, is inserted into the terminal receiving chamber 5 of the housing 3, and at this time the oil retaining plug 21, held on the flat plate portion 31, is also easily inserted into the terminal receiving chamber 5. The wire 9, compressively fixed to the covering clamping portion 27*a* and the conductor clamping portion 27*b*, extends from the rear side of the terminal receiving chamber 5 into the oil 11. Another connector 13 is connected to the other end of the wire 9 disposed in the oil 11. The connector 13 is connected to an electric component (not shown) in the oil 11. A rear holder 33 is mounted at a rear portion of the terminal receiving chamber 5, and the wire 9 extends through and is retained by this rear holder 33, and the rear holder 33 prevents the terminal 7 from being disengaged from the terminal receiving chamber 5.

An oil interrupting connector 35 comprises as main components the housing 3, the terminal 7 and the oil retaining plug 21.

The operation of the oil interrupting connector 35 of this construction will now be described.

When the oil 11 intrudes into a gap between the conductor 17 and the covering 19 of the connector 13 provided in the oil 11, the oil 11 moves toward the housing 3 along the conductor 17 because of a capillary phenomenon. The oil 11, thus moved into the housing 3, passes past the covering clamping portion 27*a*, and flows into the terminal receiving chamber 5 through a gap between the conductor 17 and the covering 19 disposed within the housing 3. However, the oil retaining plug 21 forms a seal between the terminal 7 and the inner surface of the terminal receiving chamber 5, and therefore the oil is interrupted by the oil retaining plug 21, so that the oil 11 will not intrude into a fitting side of the terminal 7.

The rear portion of the terminal receiving chamber 5, though provided with the rear holder 33, is open, and therefore the oil 11, flowing into the terminal receiving chamber 5, can be easily discharged from this chamber 5, and the thus discharged oil 11 is returned to an oil reservoir portion.

In the oil interrupting connector 35 of the above embodiment, an enhanced operation efficiency and the reduction of the weight and manufacturing cost (which are the object of the present invention) can be achieved, and besides even if the oil 11 flows into the terminal receiving chamber 5, the oil can be easily discharged since the rear portion of this chamber is open. In the conventional construction, it is extremely difficult to discharge oil once flowed into the silicone-filled portion, so that the risk of intrusion of the oil into the fitting side is increased. With the construction of the present invention, this can be avoided.

Although the above oil retaining plug 21 has one annular lip 23 formed on the outer periphery thereof, a plurality of such annular lips 23 may be formed.

The above oil retaining plug 21 has the annular lip 23 formed in a bulged manner on the outer periphery thereof, and this lip 23 is held in intimate contact with the inner periphery of the terminal receiving chamber 5. However, in contrast, a plurality of annular peripheral grooves may be formed in the outer periphery of the oil retaining plug 21, and the outer periphery of the oil retaining plug 21 may be held directly in intimate contact with the inner periphery of the terminal receiving chamber 5.

Although the oil retaining plug 21 is attached by fitting the slit 25 on the flat plate portion 31, an oil retaining plug having generally the same outer shape may be integrally formed on the flat plate portion by molding. With this construction, the oil retaining plug is secured to the flat plate portion more positively, so that the insertion can be made more easily.

In the above embodiment, although the terminal is shown as a male terminal, the present invention can similarly be applied to a connector housing having female terminals received therein.

As described above in detail, in the oil interrupting connector of the present invention, when the oil retaining plug is inserted, together with the terminal, into the terminal receiving chamber, a seal is formed between the terminal and the terminal receiving chamber, thereby achieving the oil interrupting structure easily. Moreover, since the oil retaining plug is of a small block-like configuration, and hence can be mass produced, the volume is smaller than in the conventional construction in which the filler is filled in the terminal receiving chamber, and the weight can be reduced. As a result, an enhanced operation efficiency and the reduction of the weight and manufacturing cost can be achieved.

Where the lip is formed on the outer periphery of the oil retaining plug, a line-contact seal is positively formed between the inner periphery of the terminal receiving chamber and the outer periphery of the oil retaining plug, thereby further enhancing the oil interrupting ability.

Furthermore, where the slit for holding the terminal is formed in the oil retaining plug, the holding can be completely merely by fitting the oil retaining plug on the terminal, and the attachment of the oil retaining plug can be effected quite easily.

What is claimed is:

1. An oil interrupting electrical connector comprising:

a connector housing extends through a support member in intimate contact therewith, the connector housing provided with a terminal receiving chamber in an inner portion thereof; and an elastomeric oil retaining plug held on an electrical terminal, an outer periphery of the oil retaining plug being in intimate contact with an inner periphery of the terminal receiving chamber, and the oil retaining plug surrounding and being in intimate contact with a first portion of the terminal, the entire oil retaining plug disposed between a conductor clamping portion and a positioning stabilizer of the terminal, so that the oil retaining plug forms a seal between the inner periphery of the oil retaining plug and the terminal.

2. An oil interrupting connector according to claim 1, in which an annular lip is formed on the outer periphery of the oil retaining plug, and is held in intimate contact with the inner periphery of the terminal receiving chamber.

3. An oil interrupting connector according to claim 1; wherein a slit is formed in the oil retaining plug, and is fitted on the first portion to surround the first portion in intimate contact therewith.

4. An oil interrupting connector according to claim 2, wherein a slit is formed in the oil retaining plug, and is fitted on the first portion to surround the first portion in intimate contact therewith.

* * * * *